US007451709B2

(12) United States Patent
Swartfager et al.

(10) Patent No.: US 7,451,709 B2
(45) Date of Patent: Nov. 18, 2008

(54) PORTABLE COOLER AND TABLE

(76) Inventors: Brian Allen Swartfager, 4465 Mount Troy Rd. Extension, Pittsburgh, PA (US) 15214; Andrew William Shilling, 4465 Mount Troy Rd. Extension, Pittsburgh, PA (US) 15214; Christopher David Senard, 370 18th Ave., Brick, NJ (US) 08724; Michael Joseph Slifko, 151 McMichael Rd., Carnegie, PA (US) 15106

( * ) Notice: Subject to any disclaimer, the term of this patent is extended or adjusted under 35 U.S.C. 154(b) by 121 days.

(21) Appl. No.: 11/235,567

(22) Filed: Sep. 26, 2005

(65) Prior Publication Data

US 2006/0065665 A1 Mar. 30, 2006

Related U.S. Application Data

(60) Provisional application No. 60/613,616, filed on Sep. 27, 2004.

(51) Int. Cl.
*A45F 3/00* (2006.01)

(52) U.S. Cl. ..... 108/14; 190/11; 312/241; 312/313; 280/30; 220/592.2

(58) Field of Classification Search ..... 108/11, 108/13, 14, 17, 18, 65, 69, 156, 38, 50.14; 312/280, 240, 241, 317.3, 313–316; 220/592.2, 220/592.03, 722; 280/30; 62/457.7; 190/11
See application file for complete search history.

(56) References Cited

U.S. PATENT DOCUMENTS 2,603,500 A * 7/1952 Messier ..... 280/30
3,394,666 A * 7/1968 Pearlman ..... 108/129
3,516,523 A * 6/1970 Pemberton, Jr. ..... 190/11
3,873,114 A * 3/1975 Brown ..... 280/30
3,979,007 A * 9/1976 Thornbloom, Jr. ..... 220/522
4,195,889 A * 4/1980 Coyne ..... 312/240
4,400,951 A * 8/1983 Cherry ..... 62/258
4,581,902 A 4/1986 Starck et al.
4,625,656 A 12/1986 Brickman
D299,796 S 2/1989 White
4,995,322 A * 2/1991 Frederick ..... 108/44
5,311,826 A * 5/1994 Baggiani ..... 108/166
5,480,170 A * 1/1996 Kaiser, II ..... 280/30

(Continued)

*Primary Examiner*—Janet M Wilkens
(74) *Attorney, Agent, or Firm*—Alan G. Towner, Esq.; Pietragallo Gordon Alfano Bosick & Raspanti, LLP

(57) ABSTRACT

A portable cooler and table assembly that may be easily transported in a single, self-contained unit is disclosed. The assembly may be converted for use as a table for a variety of recreational activities, e.g., dining, drinking, games such as ping pong, beer pong, table hockey, card games, board games, preparation for sporting events and meals. The table and cooler may be permanently attached to each other, or alternatively, the cooler may be detachable from the table. The table may fold or collapse to assist in converting the assembly from a compact, lightweight transportable unit into a fully extended and operable table and cooler. The table surface may contain surface features such as grooves, indentations, nets, game pieces, etc. The cooler may comprise any container that is capable of containing ice or some other refrigeration or heating system, e.g., a conventional 54 quart beverage cooler. Alternatively, the cooler may be replaced with a storage container or other storage device. The assembly may also contain various wheels, legs and handles to assist in mobility and conversion.

17 Claims, 7 Drawing Sheets

U.S. PATENT DOCUMENTS 5,551,558 A * 9/1996 Bureau ..... 206/223
5,860,281 A 1/1999 Coffee et al.
5,947,032 A 9/1999 Meier
6,116,674 A * 9/2000 Allison et al. ..... 296/37.8
6,131,929 A 10/2000 Haley
6,174,026 B1 * 1/2001 Wise ..... 297/120
6,213,265 B1 * 4/2001 Wang ..... 190/11
6,264,216 B1 * 7/2001 Wilson ..... 280/30
6,302,097 B1 10/2001 Rivera
6,328,179 B1 12/2001 Conrado et al.
6,354,611 B1 3/2002 Mihalic et al.
6,575,155 B2 6/2003 Brennan
6,612,217 B1 * 9/2003 Shockey et al. ..... 89/36.11
6,648,349 B1 11/2003 Waller et al.
6,725,855 B1 4/2004 Brennan
6,920,995 B2 7/2005 Bowen et al.
6,997,111 B2 2/2006 Giegerich
7,163,262 B2 * 1/2007 Anglin ..... 297/217.1

* cited by examiner

PORTABLE COOLER AND TABLE

CROSS-REFERENCE TO RELATED APPLICATION

This application claims the benefit of U.S. Provisional Patent Application Ser. No. 60/613,616 filed Sep. 27, 2004, which is incorporated herein by reference.

FIELD OF THE INVENTION

The present invention relates to a portable cooler and table assembly, and more particularly relates to a cooler with an extendable table top that may be used for various activities, such as a game table, beer pong table, food preparation or serving table, or the like.

BACKGROUND INFORMATION

In the past, partygoers, tailgaters, outdoor enthusiasts, and the like have been required to transport a separate cooler and table to various locations for use in recreational activities. These recreational activities may include dining, drinking, games such as ping pong, beer pong, table hockey, card games, board games, preparation for sporting events and meals. Typically, more than one person is required to transport the separate table and cooler, and a large amount of cargo space is required.

One type of table top game involves throwing or bouncing balls across the table in an attempt to land the balls in drink cups across the table. For example, beer pong is a modified version of ping pong in which the players place cups of beer on the game table. The game can be played by one or more player per team. Each player makes a throw with a ping pong ball and tries to get the ball in the cups across the table. If the ping pong ball goes into a cup, the opponent is required to drink the contents of the cup. The winner is the player who successfully depletes the drinks on the opponent's side of the table.

SUMMARY OF THE INVENTION

The present invention provides a portable cooler and table assembly that may be easily transported in a single, self-contained unit. The assembly may be converted for use as a table for a variety of recreational activities, e.g., dining, drinking, games such as ping pong, beer pong, table hockey, card games, board games, preparation for sporting events and meals. The table and cooler may be permanently attached to each other, or alternatively, the cooler may be detachable from the table. The table may fold or collapse to assist in converting the assembly from a compact, lightweight transportable unit into a fully extended and operable table and cooler. The table may have any suitable size and may be made from any suitable, durable material. The table surface may contain surface features such as grooves, indentations, nets, game pieces, etc. For example, if the table is used for the game beer pong, the table surface may contain cut-outs or grooves that serve as beer cup holders or ping pong ball holders. The cooler may comprise any container that is capable of containing ice or some other refrigeration or heating system, e.g., a conventional 54 quart beverage cooler. Alternatively, the cooler may be replaced with a storage container or other storage device. The assembly may also contain various wheels, legs and handles to assist in mobility and conversion.

An aspect of the present invention is to provide a portable cooler and table assembly comprising a cooler base, extendable legs connected to the cooler base, and extendable table sections connected to the cooler base.

Another aspect of the present invention is to provide a portable cooler and table assembly comprising a cooler base having sidewalls, and endwalls and extendable table sections connected adjacent to the endwalls of the cooler base.

These and other aspects of the present invention will be more apparent from the following description.

DETAILED DESCRIPTION

Figure 1:
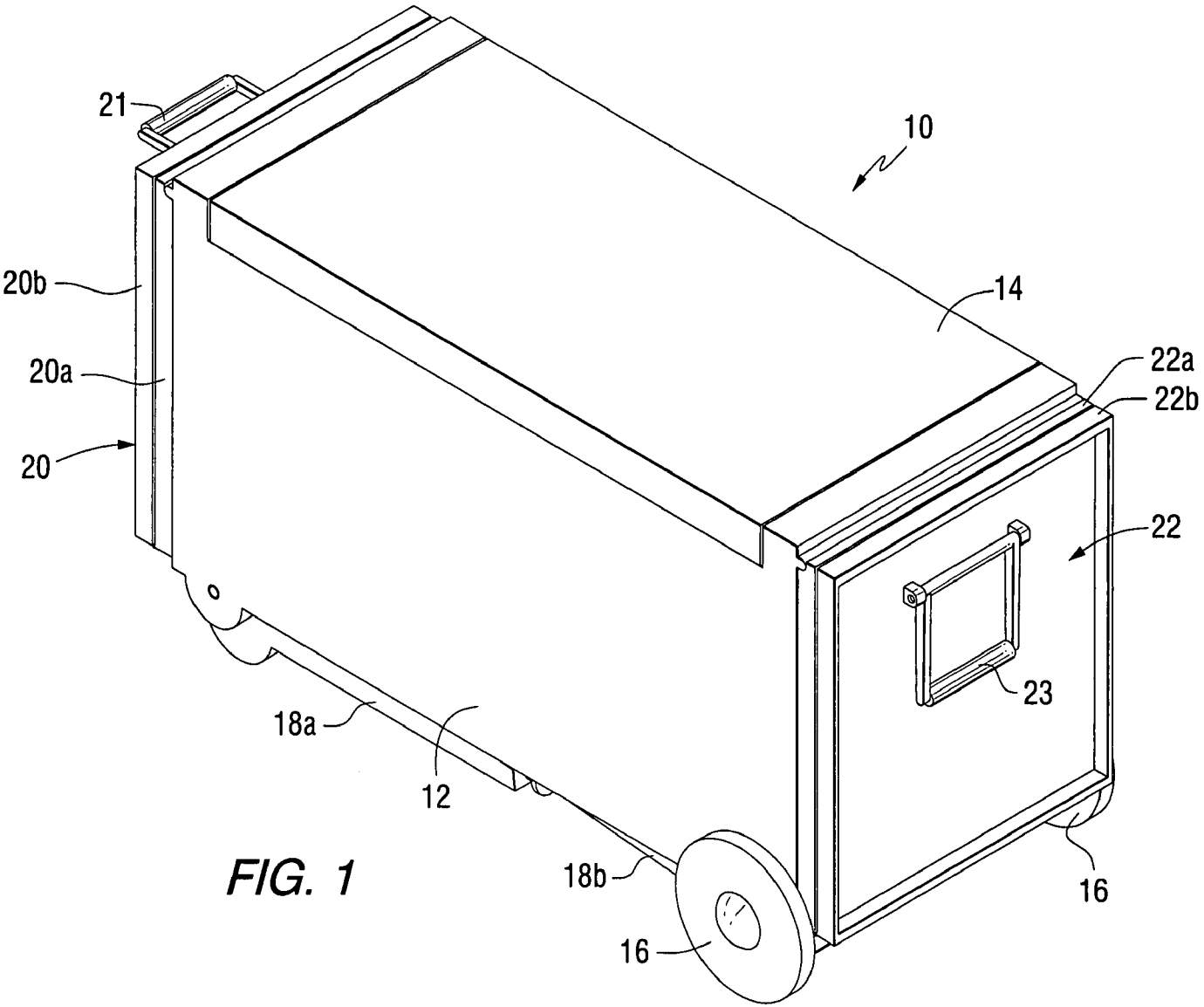
FIG. 1 is an isometric view of a portable cooler and table assembly in a collapsed position in accordance with an embodiment of the present invention.
Figure 3:
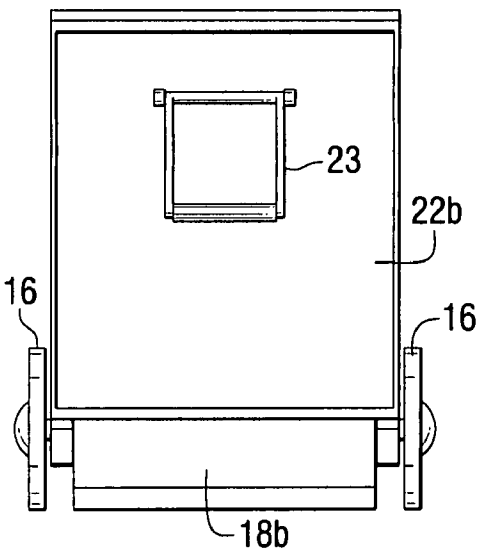
FIG. 3 is an end view of the collapsed portable cooler and table assembly of FIG. 1.
Figure 4:
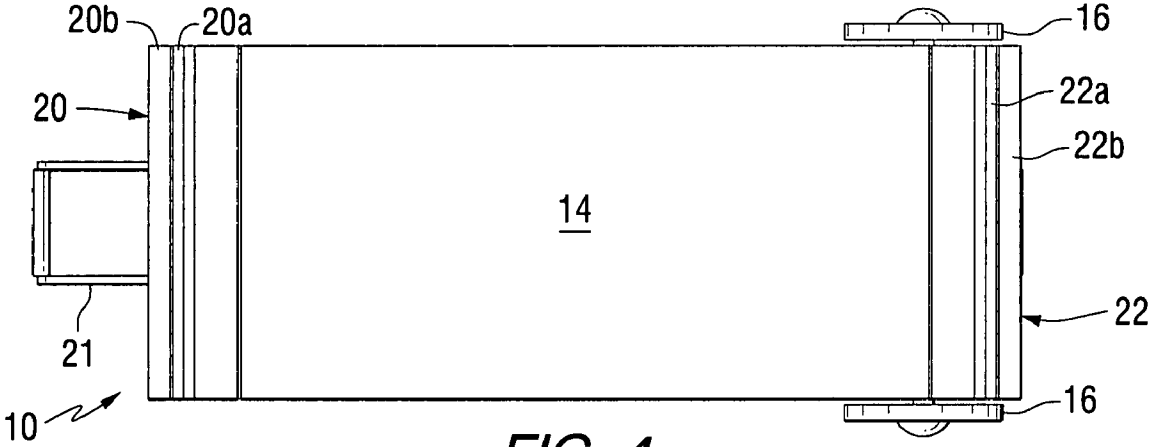
FIG. 4 is a top view of the collapsed portable cooler and table assembly of FIG. 1.
Figure 2:
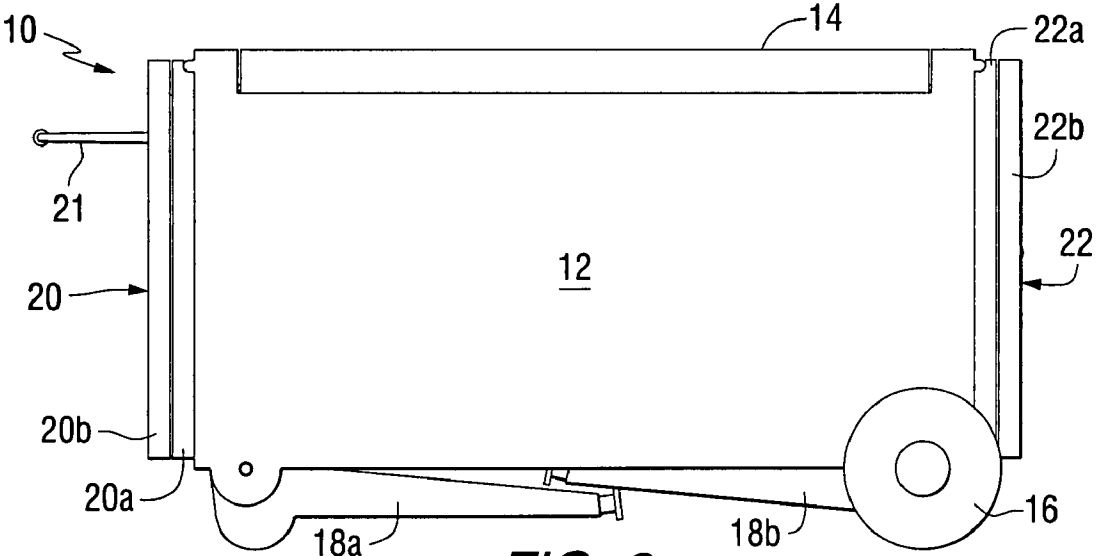
FIG. 2 is a side view of the collapsed portable cooler and table assembly of FIG. 1.

FIGS. 1-4 illustrate a portable cooler and table assembly 10 in accordance with an embodiment of the present invention. In these figures, the assembly 10 is in a collapsed or stowed position. The cooler and table assembly 10 includes a base 12 which serves as a cooler. The cooler base 12 includes two sidewalls and two endwalls which are narrower than the sidewalls. A lid 14 is mounted on a sidewall of the cooler base 12 by any suitable means such as hinges or a slide mounting. Wheels 16 are mounted on the bottom near one end of the cooler base 12. Foldable leg assemblies 18*a* and 18*b* are mounted on the bottom of the cooler base 12 at opposite ends of the base.

A folding table section 20 comprising table leaves 20*a* and 20*b* is mounted at one end of the cooler and table assembly 10. Another folding table section 22 comprising table leaves 22*a* and 22*b* is mounted at the opposite end of the cooler and table assembly 10. Handles 21 and 23 are mounted on the folding table sections 20 and 22, respectively. The handles 21 and 23 can pivot from stowed positions in which they extend downward and rest against their respective folding table sections, to deployed positions in which they extend substantially horizontally from their folding table sections. In FIGS. 1-4, the handle 21 is shown in the extended position, while the handle 23 is shown in the stowed position.

FIGS. 5-10 illustrate the portable cooler and table assembly 10 in an extended position. In this position, the foldable leg assemblies 18*a* and 18*b* are rotated downward away from the cooler base 12 to elevate the portable cooler and table assembly 10 to the desired height. In the embodiment shown in FIGS. 5-10, the leg assemblies 18*a* and 18*b* are rotated slightly past the vertical direction in order to provide a suitably wide base with provides additional support for the extended cooler and table assembly 10. The foldable leg assemblies 18*a* and 18*b* may be pivotally mounted on the cooler base 12 by any suitable means such as hinges. Alternatively, instead of the pivotally mounted leg assemblies 18*a* and 18*b*, sliding or telescoping leg assemblies may be used in accordance with the present invention. Also, a combination of folding and telescoping legs may be used.

As shown in FIGS. 5-10, the table leaves 20*a* and 20*b*, as well as the table leaves 22*a* and 22*b*, are extended away from the cooler base 12 to substantially horizontal positions level with the lid 14. Each table leaf 20*a* and 22*a* may be pivotally connected to the cooler base 12 by any suitable means such as hinges. Each table leaf 20*b* and 22*b* is pivotally mounted to its adjacent table leaf 20*a* and 22*a*, respectively, by any suitable means such as hinges. Alternatively, the table leaves 20*b* and 22*b* may be connected to their respective adjacent table leaves 20*a* and 22*a* by a sliding or telescoping connection. The table leaves 20*a*, 20*b*, 22*a* and 22*b* may be permanently mounted on the cooler base 12, or they may be removably mounted.

Figure 5:
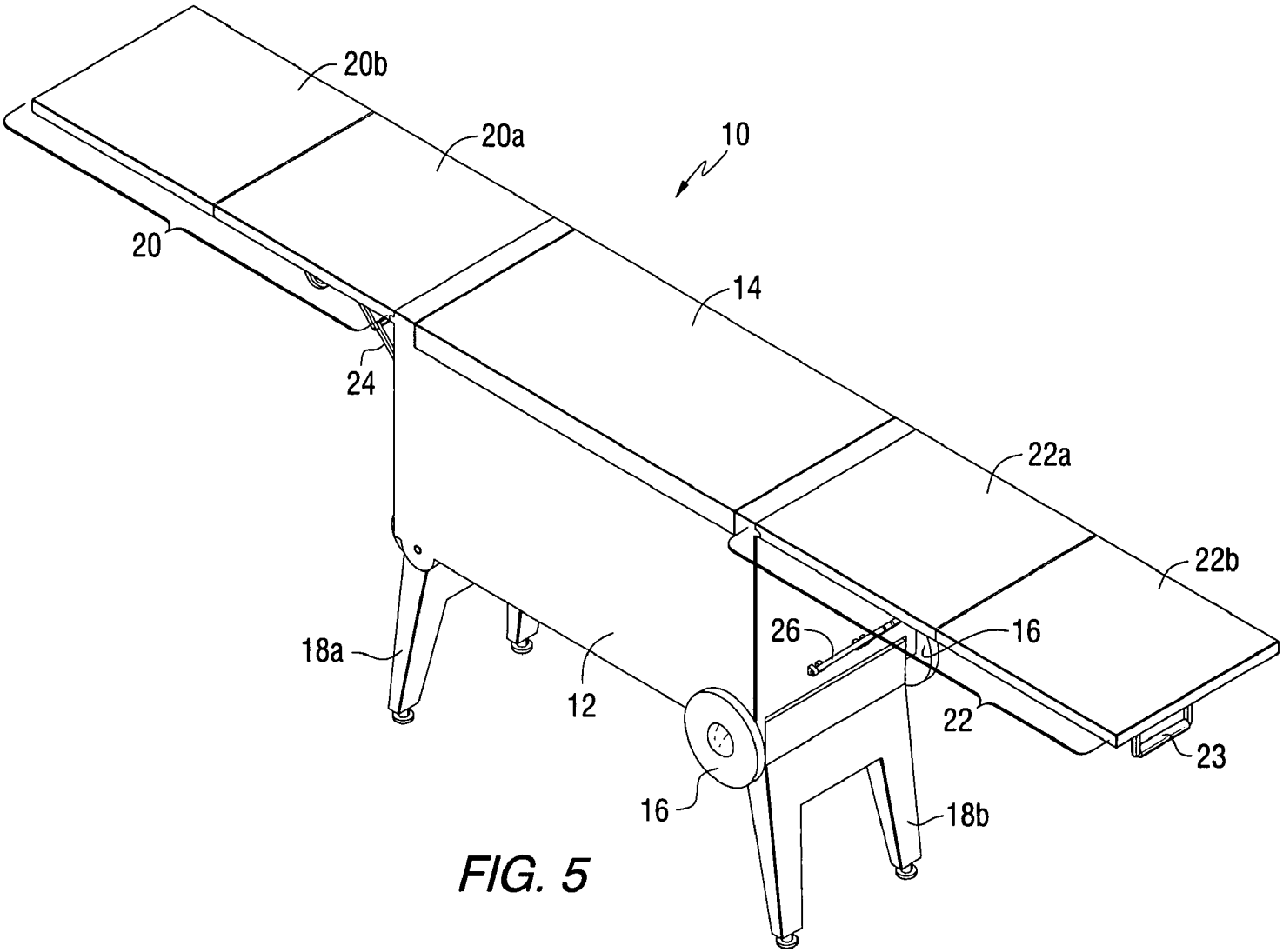
FIG. 5 is an isometric view of a portable cooler and table assembly in an extended position in accordance with an embodiment of the present invention.
Figure 6:
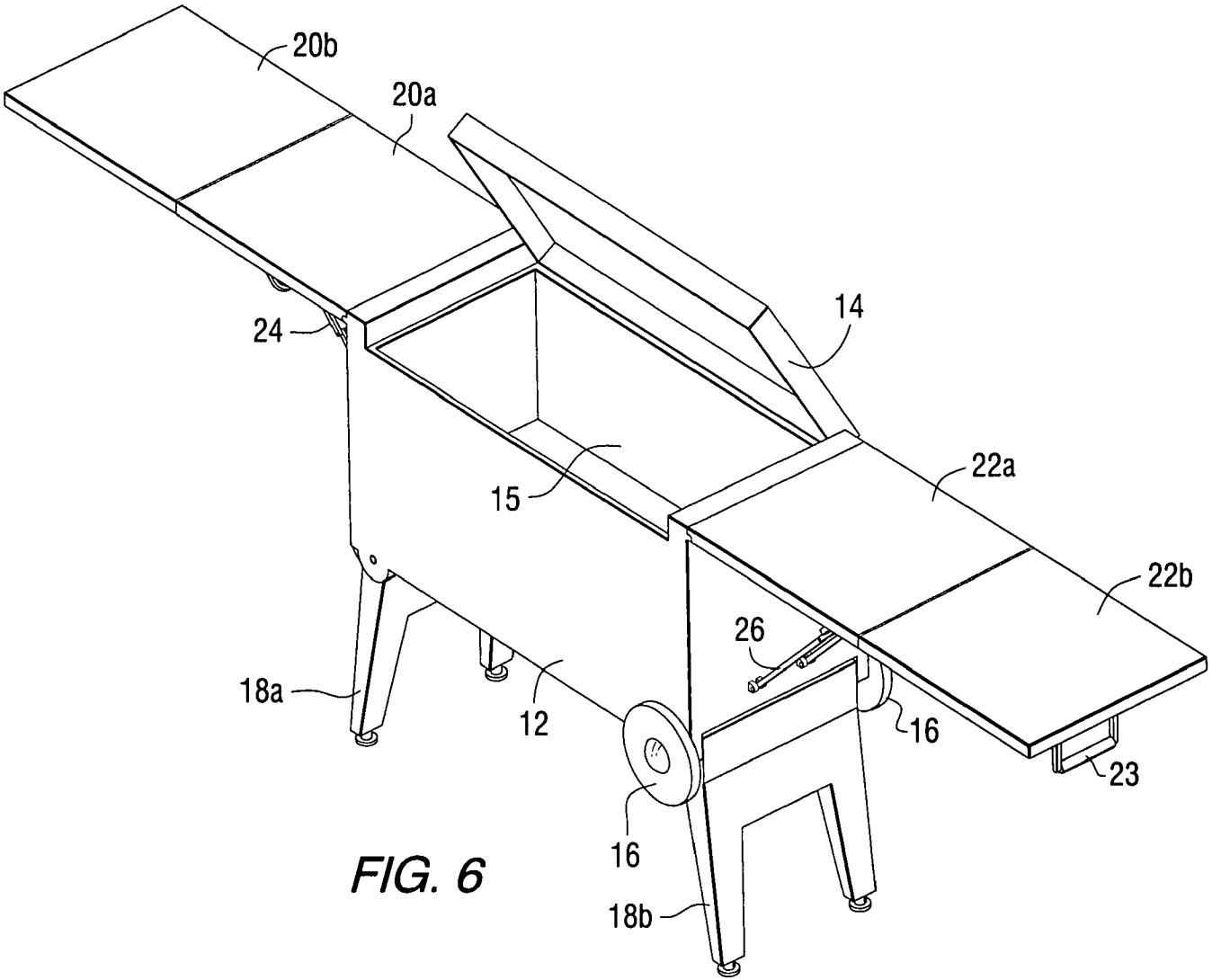
FIG. 6 is an isometric view of the extended portable cooler and table assembly of FIG. 5, with the lid in an open position.

As shown in FIGS. 5 and 6, the cooler lid 14 may comprise a portion of the table surface which is level with the extended leaves 20*a*, 20*b*, 22*a* and 22*b*. The lid 14 may continue to be opened and closed in order to allow access to the contents of the cooler while the table is in the extended position.

Figure 7:
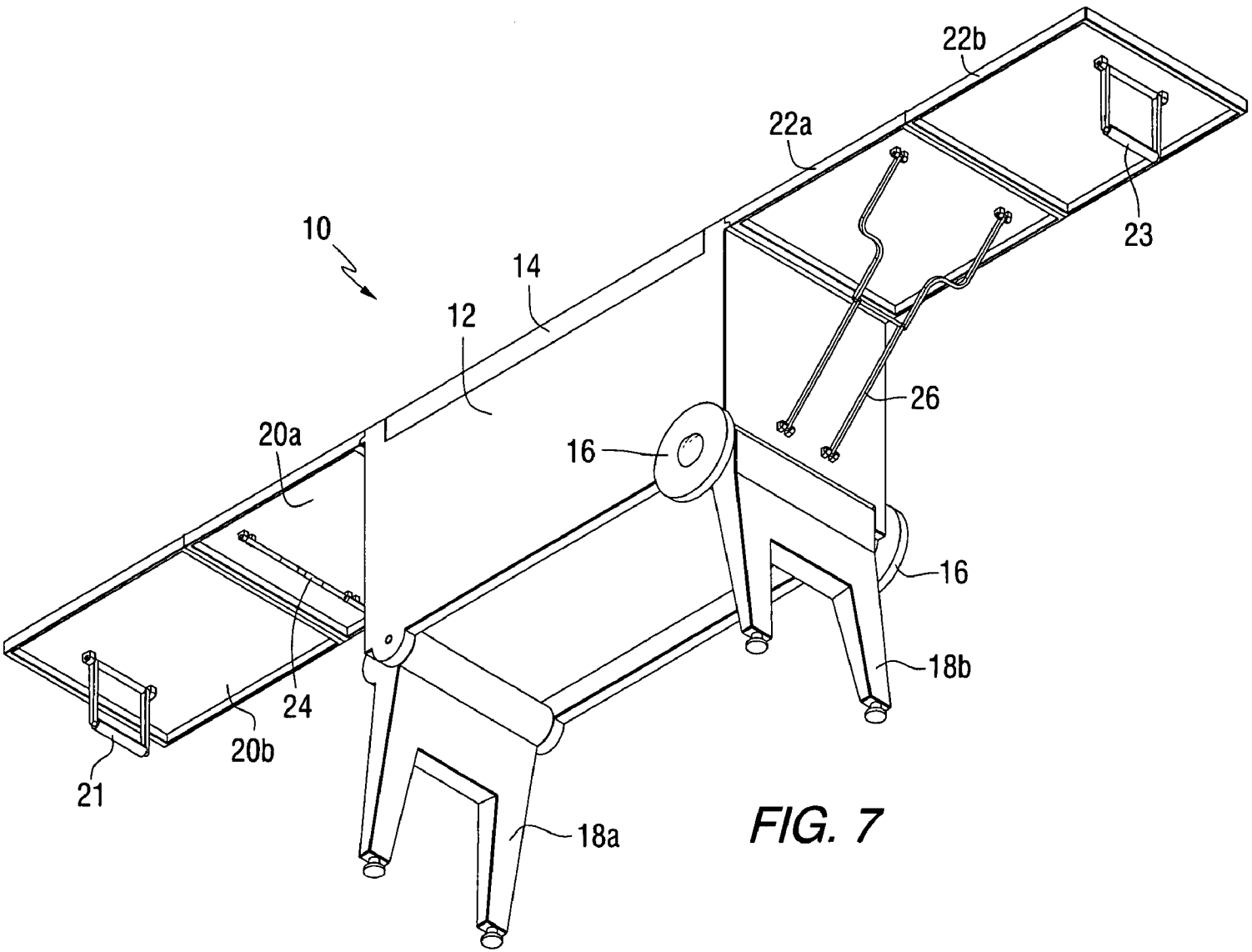
FIG. 7 is a bottom isometric view of the extended portable cooler and table assembly of FIG. 5.
Figure 9:
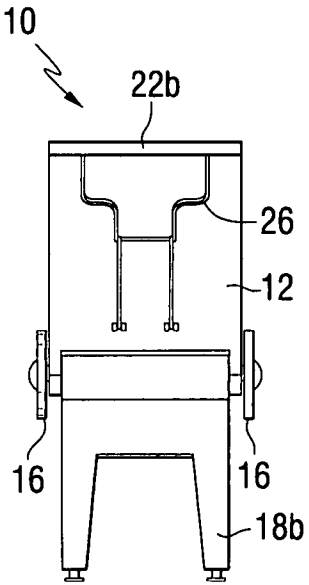
FIG. 9 is an end view of the extended portable cooler and table assembly of FIG. 5.
Figure 10:
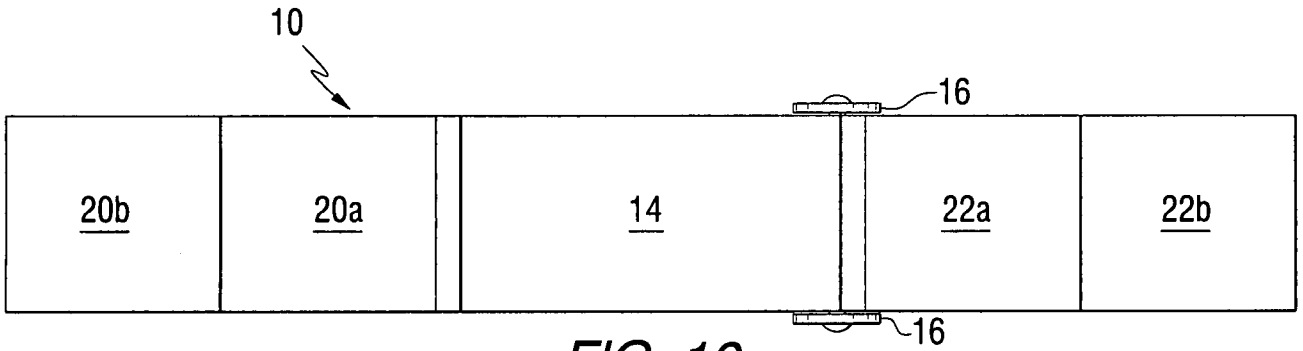
FIG. 10 is a top view of the extended portable cooler and table assembly of FIG. 5.
Figure 8:
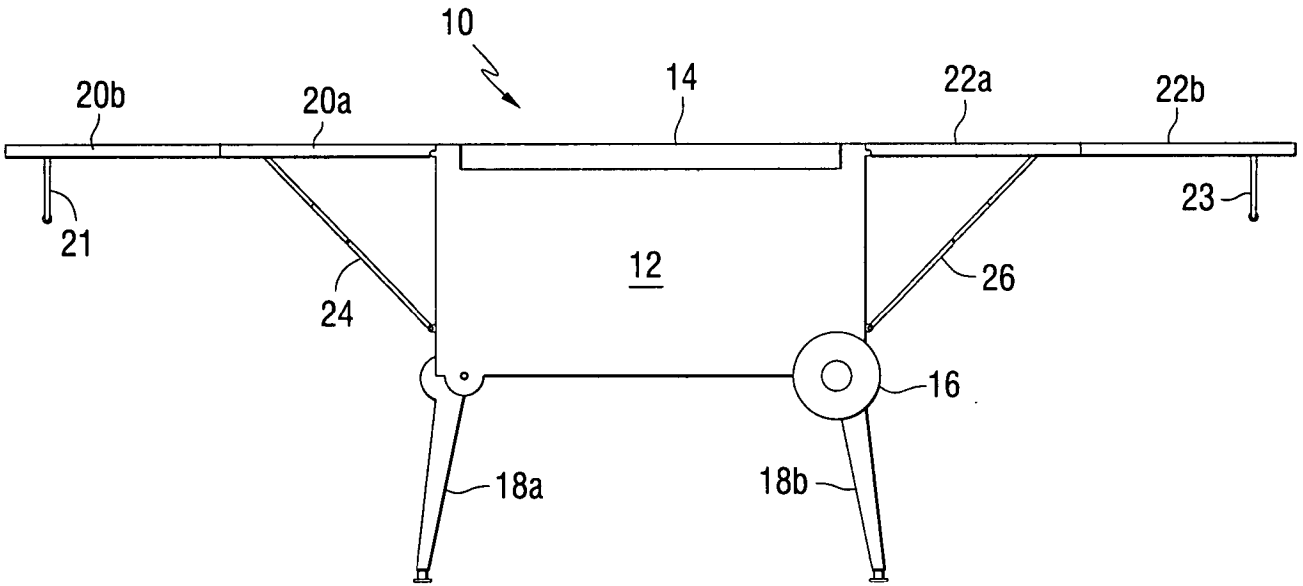
FIG. 8 is a side view of the extended portable cooler and table assembly of FIG. 5.

As most clearly shown in FIGS. 7-9, each folding table section 20 and 22 is supported by a collapsible or foldable table support 24 and 26, respectively. The foldable table support 24 extends from the table leaf 20*a* to a lower portion of the cooler base 12. Similarly, the foldable table support 26 extends from the table leaf 22*a* to a lower portion of the cooler base 12.

Figure 11:
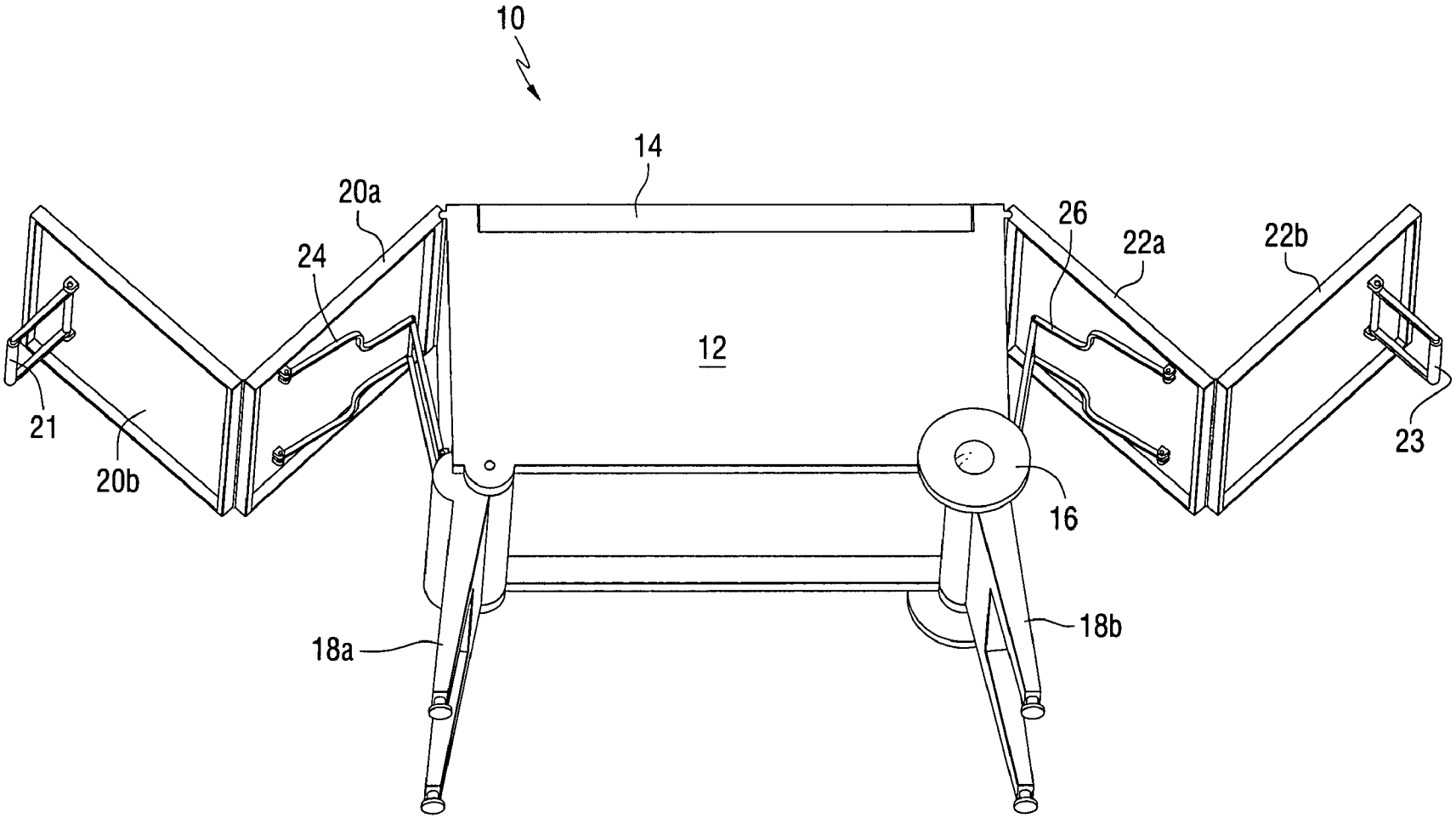
FIG. 11 is a bottom isometric view illustrating the portable cooler and table assembly of the present invention in a partially extended position.

FIG. 11 illustrates the cooler and table assembly 10 in a partially extended position. In this position, the table leaves 20*a*, 20*b*, 22*a* and 22*b* are pivoted from their stowed positions toward their extended positions. The table supports 24 and 26 are also pivoted from their folded or stowed positions toward their extended straight positions.

In accordance with the present invention, in the extended positions as shown in FIGS. 5-10, a substantially flat table top is provided at a desired height from the ground or floor. For example, the height of the extended table may be from about 20 to about 48 inches, with a height of about 36 or 38 inches being particularly suitable for many uses.

The extended table top as shown in FIGS. 5-10 has a length and width which are selected based on the desired use of the table. For many uses, the length of the extended table top may be from about 40 to about 120 inches, with a length of about 90 inches being particularly suitable for many uses. The width of the extended table top may range from about 10 to about 30 inches, with a width of about 20 inches being particularly suitable for many uses.

The extended table top may include markings or surface features as desired. For example, the table top may comprise cup holders or markers, game piece holders or markers, and the like.

In accordance with an embodiment of the present invention, by extending the table leaves 20*a*, 20*b*, 22*a* and 22*b* from the ends of the cooler base 12, a relatively long and narrow table top is provided which is suitable for use, for example, as a beer pong table. The ratio of the length to the width of the extended table top may be from about 2:1 or 3:1 to about 10:1 or higher. In the embodiment shown in FIGS. 5-10, the total length of the extended table top is about three times greater than the length of the cooler base 12, while the width of the extended table top is approximately equal to the width of the cooler base 12. Furthermore, the length of each individual table section 20 (comprising leaves 20*a* and 20*b*) and 22 (comprising leaves 22*a* and 22*b*) is approximately twice the height of the cooler base 12. Also, each extended table section 20 and 22 has a length approximately equal to the length of the cooler base 12.

The various components of the portable cooler and table assembly 10 may be made of any suitable materials. For example, the cooler base 12 and lid 14 may be made from standard insulating materials with plastic and/or metal sheet coverings. Alternatively, the cooler base 12 may comprise a container made of noninsulating material. The folding leg assemblies 18*a* and 18*b* may be made of plastic, metal or the like. The handles 21 and 23, and the table supports 24 and 26 may be made of metal, hard plastic or the like. The table leaves 20*a*, 20*b*, 22*a* and 22*b* may be made of plastic, metal or the like.

Whereas particular embodiments of this invention have been described above for purposes of illustration, it will be evident to those skilled in the art that numerous variations of the details of the present invention may be made without departing from the invention as defined in the appended claims.

The invention claimed is:

1. A portable cooler and table assembly comprising:

a thermally insulated cooler base;

extendable legs connected to the cooler base;

extendable table sections connected to the cooler base, wherein the extendable table sections are connected to opposite sides or ends of the cooler base, wherein each extendable table section is movable from a substantially vertical stowed position adjacent one of the sides or ends to a substantially horizontal extended position and each extendable table section comprises multiple table leaves; and a handle attached to a first one of the table leaves and positioned to be grasped when the first table leaf is in the stowed position adjacent to the cooler base.

2. The portable cooler and table assembly of claim 1, wherein the table leaves are pivotally connected to each other.

3. The portable cooler and table assembly of claim 1, wherein one of the table leaves is pivotally mounted on the cooler base.

4. The portable cooler and table assembly of claim 1, wherein the extendable table sections are pivotally mounted on the cooler base.

5. The portable cooler and table assembly of claim 1, further comprising a foldable support connected to each extendable table section and connected to the cooler base.

6. The portable cooler and table assembly of claim 1, further comprising another handle attached to a second one of the table leaves and positioned to be grasped when the second table leaf is in the stowed position adjacent to the cooler base.

7. The portable cooler and table assembly of claim 1, wherein the extendable legs are pivotally mounted on the cooler base.

8. The portable cooler and table assembly of claim 7, wherein each extendable leg rotates from a stowed position adjacent to a bottom of the cooler base to an extended position which is rotated past a vertical plane.

9. A portable cooler and table assembly comprising:

a thermally insulated cooler base having sidewalls and endwalls;

extendable table sections connected adjacent to the endwalls of the cooler base, wherein each extendable table section is movable from a substantially vertical stowed position adjacent one of the end walls to a substantially horizontal extended position and each extenable table section comprises multiple table leaves; and a handle attached to a first one of the table leaves and positioned to be grasped when the first table leaf is in the stowed position adjacent to the cooler base.

10. The portable cooler and table assembly of claim 9, wherein the table leaves are pivotally connected to each other.

11. The portable cooler and table assembly of claim 9, wherein one of the table leaves is pivotally mounted on the cooler base.

12. The portable cooler and table assembly of claim 9, wherein the extendable table sections are pivotally mounted on the cooler base.

13. The portable cooler and table assembly of claim 9, further comprising a foldable support connected to each extendable table section and connected to the cooler base.

14. The portable cooler and table assembly of claim 9, further comprising another handle attached to a second one of the table leaves and positioned to be grasped when the second table leaf is in the stowed position adjacent to the cooler base.

15. The portable cooler and table assembly of claim 9, further comprising extendable legs connected to the cooler base.

16. The portable cooler and table assembly of claim 15, wherein the extendable legs are pivotally mounted on the cooler base.

17. The portable cooler and table assembly of claim 16, wherein each extendable leg rotates from a stowed position adjacent to a bottom of the cooler base to an extended position which is rotated past a vertical plane.

* * * * *